US009222047B2

(12) United States Patent
Brewer

(10) Patent No.: US 9,222,047 B2
(45) Date of Patent: Dec. 29, 2015

(54) LIQUID FUEL COMPOSITIONS

(71) Applicant: SHELL OIL COMPANY, Houston, TX (US)

(72) Inventor: Mark Lawrence Brewer, Chester (GB)

(73) Assignee: Shell Oil Company, Houston, TX (US)

( * ) Notice: Subject to any disclaimer, the term of this patent is extended or adjusted under 35 U.S.C. 154(b) by 27 days.

(21) Appl. No.: 14/134,890

(22) Filed: Dec. 19, 2013

(65) Prior Publication Data

US 2014/0173973 A1 Jun. 26, 2014

(30) Foreign Application Priority Data

Dec. 21, 2012 (EP) ..... 12199119

(51) Int. Cl.

| | |
|---|---|
| ***C10L 1/18*** | (2006.01) |
| ***C10L 10/12*** | (2006.01) |
| ***C10L 1/223*** | (2006.01) |
| ***C10L 1/185*** | (2006.01) |
| ***C10L 1/189*** | (2006.01) |
| ***C10L 1/19*** | (2006.01) |
| ***C10L 1/22*** | (2006.01) |
| ***C10L 1/20*** | (2006.01) |
| ***C10L 1/222*** | (2006.01) |
| ***C10L 1/228*** | (2006.01) |
| ***C10L 1/24*** | (2006.01) |

(52) U.S. Cl.

CPC ..... *C10L 1/223* (2013.01); *C10L 1/189* (2013.01); *C10L 1/1852* (2013.01); *C10L 1/1857* (2013.01); *C10L 1/19* (2013.01); *C10L 1/202* (2013.01); *C10L 1/22* (2013.01); *C10L 1/2225* (2013.01); *C10L 1/2286* (2013.01); *C10L 1/2437* (2013.01); *C10L 10/12* (2013.01)

(58) Field of Classification Search

CPC ..... C10L 1/223; C10L 1/2437; C10L 1/202; C10L 1/2225; C10L 1/1857; C10L 1/2286; C10L 1/06; C10L 1/22; C10L 1/189; C10L 10/00; C10L 1/1852; C10L 1/19; C10L 10/12

USPC ..... 123/1 A; 44/384, 385, 388, 405, 410, 44/437

See application file for complete search history.

(56) References Cited

U.S. PATENT DOCUMENTS

| | | | | |
|---|---|---|---|---|
| 3,505,226 | A | 4/1970 | Cyba | |
| 4,208,190 | A | 6/1980 | Malec | |
| 4,744,798 | A * | 5/1988 | Andress | 44/418 |
| 5,348,561 | A * | 9/1994 | Sexton et al. | 44/422 |
| 5,378,348 | A | 1/1995 | Davis et al. | |
| 5,490,864 | A | 2/1996 | Herbstman et al. | |
| 5,766,274 | A | 6/1998 | Wittenbrink et al. | |
| 5,888,376 | A | 3/1999 | Wittenbrink et al. | |
| 5,990,056 | A * | 11/1999 | Kremer et al. | 508/578 |
| 6,204,426 | B1 | 3/2001 | Miller et al. | |
| 6,448,208 | B1 * | 9/2002 | Dubs et al. | 508/229 |
| 2006/0242892 | A1 * | 11/2006 | Siggelkow et al. | 44/393 |
| 2008/0236029 | A1 * | 10/2008 | Wilkins | 44/308 |
| 2010/0161029 | A1 * | 6/2010 | Filippini et al. | 623/1.15 |
| 2012/0010112 | A1 | 1/2012 | Grabarse et al. | |
| 2012/0102826 | A1 | 5/2012 | Fang | |

FOREIGN PATENT DOCUMENTS

| | | |
|---|---|---|
| EP | 147240 | 7/1985 |
| EP | 482253 | 4/1992 |
| EP | 557516 | 4/1993 |
| EP | 613938 | 9/1994 |
| EP | 1101813 | 5/2001 |
| EP | 583836 | 2/2002 |
| EP | 1717296 | 11/2006 |
| GB | 960493 | 6/1964 |
| GB | 2325672 | 12/1998 |
| JP | 2000026872 | 1/2000 |
| WO | 9533805 | 12/1995 |
| WO | 9603397 | 2/1996 |
| WO | 9714768 | 4/1997 |
| WO | 9714769 | 4/1997 |
| WO | 9801516 | 1/1998 |
| WO | WO 9801516 A1 * | 1/1998 |
| WO | 9842808 | 10/1998 |
| WO | 9932584 | 1/1999 |
| WO | WO0011116 | 3/2000 |
| WO | WO0011117 | 3/2000 |
| WO | WO0020534 | 4/2000 |
| WO | WO0020535 | 4/2000 |
| WO | WO0183406 | 11/2001 |
| WO | WO0183641 | 11/2001 |
| WO | WO0183647 | 11/2001 |
| WO | WO0183648 | 11/2001 |
| WO | 2008056203 | 5/2008 |
| WO | 2008135602 | 11/2008 |
| WO | 2011095819 | 8/2011 |
| WO | 2011110860 | 9/2011 |
| WO | 2011149799 | 12/2011 |

OTHER PUBLICATIONS

Danping W.: The Lubricity of Diesel Fuels, Research Institute of Petroleum Processing, Beijing, china; Jan. 29, 1986; pp. 217-235.

Sagarin, et al.: Cosmetics Science and Technology, Wiley-Interscience, 2nd Edition, vol. 1, pp. 189, 1972.

* cited by examiner

*Primary Examiner* — Pamela H Weiss

(57) ABSTRACT

A liquid fuel composition containing (a) a diesel base fuel suitable for use in an internal combustion engine; and (b) one or more organic sunscreen compounds.

The liquid fuel composition of the present invention provides benefits in terms of power output of a diesel engine, and modifying the ignition delay and/or modifying the burn period and/or increasing the cetane number of the liquid fuel composition.

4 Claims, No Drawings

LIQUID FUEL COMPOSITIONS

This present application claims the benefit of European Patent Application No. 12199119.4, filed Dec. 21, 2012, the entire disclosure of which is hereby incorporated by reference.

FIELD OF THE INVENTION

The present invention relates to a liquid fuel composition, in particular to a liquid fuel composition having improved fuel combustion and increased cetane number.

BACKGROUND OF THE INVENTION

The cetane number of a fuel composition is a measure of its ease of ignition and combustion. With a lower cetane number fuel a compression ignition (diesel) engine tends to be more difficult to start and may run more noisily when cold; conversely a fuel of higher cetane number tends to impart easier cold starting, to lower engine noise, to alleviate white smoke ("cold smoke") caused by incomplete combustion after.

There is a general preference, therefore, for a diesel fuel composition to have a high cetane number, a preference which has become stronger as emissions legislation grows increasingly stringent, and as such automotive diesel specifications generally stipulate a minimum cetane number. To this end, many diesel fuel compositions contain ignition improvers, also known as cetane boost additives or cetane (number) improvers/enhancers, to ensure compliance with such specifications and generally to improve the combustion characteristics of the fuel.

Organic nitrates have been known for some time as ignition accelerants in fuels, and some are also known to increase the cetane number of diesel fuels. Perhaps the most commonly used diesel fuel ignition improver is 2-ethylhexyl nitrate (2-EHN), which operates by shortening the ignition delay of a fuel to which it is added.

However, 2-EHN is also a radical initiator, and can potentially have an adverse effect on the thermal stability of a fuel. Poor thermal stability in turn results in an increase in the products of instability reactions, such as gums, lacquers and other insoluble species. These products can block engine filters and foul fuel injectors and valves, and consequently can result in loss of engine efficiency or emissions control.

The organic nitrates described in the prior art as combustion improvers and/or cetane number improvers have a series of disadvantages, especially lack of thermal stability, excessively high volatility and insufficient efficacy. However, it may be expected that by decreasing the volatility of a cetane enhancer, e.g. by using a molecule of higher molecular weight, its efficacy as a combustion improver and/or cetane number improver may then decline.

There are also health and safety concerns regarding the use of 2-EHN, which is a strong oxidising agent and is also readily combustible in its pure form. It can also be difficult to store in concentrated form as it tends to decompose, and so is prone to forming potentially explosive mixtures. Furthermore, it has been noted that 2-EHN functions most effectively under mild engine conditions.

These disadvantages, taken together with the often significant cost of incorporating 2-EHN as an additive into a fuel composition, mean that it would be generally desirable to reduce or eliminate the need for 2-EHN and other known cetane number improvers in diesel fuel compositions, whilst at the same time maintaining acceptable combustion properties.

It is therefore an object of the invention to provide cetane enhancers which are effective as combustion improvers or cetane number improvers.

SUMMARY OF THE INVENTION

It has now been found that organic sunscreen compounds can serve to modify the ignition delay and/or increase the cetane number and/or modify the burn period in diesel fuel compositions.

In an embodiment, there is provided a liquid fuel composition comprising:

(a) a diesel base fuel suitable for use in an internal combustion engine; and (b) one or more organic sunscreen compounds.

DETAILED DESCRIPTION OF THE INVENTION

The organic sunscreen has the effect of increasing the cetane number of the diesel fuel composition, such as to a desired or target cetane number. Suitably, the diesel fuel composition has a cetane number of 40 or more, 50 or more, 60 or more, or 70 or more.

In another embodiment, there is provided a use of an organic sunscreen in a diesel fuel composition for the purpose of increasing the cetane number of the diesel fuel composition.

In another embodiment, there is provided a method for increasing the cetane number of a diesel fuel composition, which method comprises adding to the composition an amount of an organic sunscreen according to the invention.

The method may involve increasing the cetane number of the diesel fuel composition to achieve a target cetane number.

The uses and methods of the present invention may additionally or alternatively be used to adjust any property of the fuel composition which is equivalent to or associated with cetane number, for example, to improve the combustion performance of the fuel composition, e.g. to modify/shorten ignition delays (i.e. the time between fuel injection and ignition in a combustion chamber during use of the fuel), to facilitate cold starting or to reduce incomplete combustion and/or associated emissions in a fuel-consuming system running on the fuel composition) and/or to improve fuel economy or exhaust emissions generally.

Hence in another embodiment, there is provided the use of an organic sunscreen compound in a diesel fuel composition for modifying the ignition delay of the diesel fuel composition.

In another embodiment, there is provided a method for modifying the ignition delay of a diesel fuel composition, which method comprises adding to the composition an amount of an organic sunscreen.

In another embodiment, there is provided a method of modifying the ignition delay of liquid fuel composition used to fuel an internal combustion engine, said method comprising fuelling the internal combustion engine with a liquid fuel composition described herein.

Still yet in another embodiment relates to a method of operating a compression ignition engine and/or a vehicle which is powered by such an engine, which method involves introducing into a combustion chamber of the engine a diesel fuel composition as described herein.

Still yet in another embodiment relates to the use of an organic sunscreen compound in a diesel fuel composition for modifying the burn period of the diesel fuel composition.

In another embodiment, there is provided a method for modifying the burn period of a diesel fuel composition, which method comprises adding to the composition an amount of an organic sunscreen.

In another embodiment, there is provided a method of modifying the burn period of a liquid fuel composition used to fuel an internal combustion engine, said method comprising fuelling the internal combustion engine with a liquid fuel composition described herein.

Suitably, the organic sunscreen also has the effect of increasing the power output and acceleration of an internal combustion engine fuelled by a diesel fuel composition of the present invention.

In order to assist with the understanding of the invention several terms are defined herein.

The terms "cetane (number) improver" and "cetane (number) enhancer" are used interchangeably to encompass any component that, when added to a fuel composition at a suitable concentration, has the effect of increasing the cetane number of the fuel composition relative to its previous cetane number under one or more engine conditions within the operating conditions of the respective fuel or engine. As used herein, a cetane number improver or enhancer may also be referred to as a cetane number increasing additive/agent or the like.

In accordance with the present invention, the cetane number of a fuel composition may be determined in any known manner, for instance using the standard test procedure ASTM D613 (ISO 5165, IP 41) which provides a so-called "measured" cetane number obtained under engine running conditions. More preferably the cetane number may be determined using the more recent and accurate "ignition quality test" (IQT; ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels.

Alternatively the Cetane number or derived ignition quality of a fuel can be tested using a Combustion Research Unit (CRU) obtained from Fueltech Solutions AS/Norway. Fuels were injected into a constant volume combustion chamber preconditioned as set conditions.

The Derived Ignition Quality (DIQ) can be determined as a function of Ignition Delay (ID) recorded as the time from start of injection (SOI) to the point where the chamber pressure has risen to 0.2 bar above the pressure before SOI. The Derived Ignition Quality (DIQ) can also be determined as a function of Ignition Delay (ID) recorded as the time from start of injection (SOI) to the point where the chamber pressure equals its initial value plus 5% of maximum pressure increase (MPI).

Alternatively, cetane number may be measured by near infrared spectroscopy (NIR), as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

In some embodiments, the methods/uses encompass adding one or more organic sunscreen compounds of the invention to a fuel composition so as to adjust the cetane number or to achieve or reach a desired target cetane number. In the context of the invention, to "reach" a target cetane number can also embrace exceeding that number. Thus, the target cetane number may be a target minimum cetane number.

The present invention suitably results in a fuel composition which has a derived cetane number (IP 498) of 50 or greater, more preferably of 51, 52, 53, 54 or 55 or greater. For example, in some embodiments the resultant fuel composition may have a cetane number of 60 or greater, 65 or greater or even 70 or greater.

The present invention may additionally or alternatively be used to adjust any property of the fuel composition which is equivalent to or associated with cetane number, for example, to improve the combustion performance of the fuel composition, e.g. to shorten ignition delays (i.e. the time between fuel injection and ignition in a combustion chamber during use of the fuel), to facilitate cold starting or to reduce incomplete combustion and/or associated emissions in a fuel-consuming system running on the fuel composition) and/or to improve fuel economy or exhaust emissions generally.

The present invention may also be used herein to modify the burn period. As used herein the term "burn period" means the time between two points in the pressure curve obtained during combustion.

Cetane number improvers of the invention may be used to increase the cetane number of a fuel composition. As used herein, an "increase" in the context of cetane number embraces any degree of increase compared to a previously measured cetane number under the same or equivalent conditions. Thus, the increase is suitably compared to the cetane number of the same fuel composition prior to incorporation of the cetane number increasing (or improving) component or additive. Alternatively, the cetane number increase may be measured in comparison to an otherwise analogous fuel composition (or batch or the same fuel composition) that does not include the cetane number enhancer of the invention. Alternatively, an increase in cetane number of a fuel relative to a comparative fuel may be inferred by a measured increase in combustability or a measured decrease in ignition delay for the comparative fuels.

The increase in cetane number (or the decrease in ignition delay, for example) may be measured and/or reported in any suitable manner, such as in terms of a percentage increase or decrease. By way of example, the percentage increase or decrease may be at least 1%, such as at least 2%. Suitably, the percentage increase in cetane number or modification in ignition delay is at least 5%, at least 10%, at least 15% or at least 20%. In some embodiments the increase in cetane number or modification in ignition delay may be at least 25%, at least 30%. However, it should be appreciated that any measurable improvement in cetane number or modification of ignition delay may provide a worthwhile advantage, depending on what other factors are considered important, e.g. availability, cost, safety and so on.

The engine in which the fuel composition of the invention is used may be any appropriate engine. Thus, where the fuel is a diesel or biodiesel fuel composition, the engine is a diesel or compression ignition engine. Likewise, any type of diesel engine may be used, such as a turbo charged diesel engine, provided the same or equivalent engine is used to measure cetane number/ignition delay/burn period with and without the organic sunscreen compound. Similarly, the invention is applicable to an engine in any vehicle. Generally, the organic sunscreen compounds used in the present invention are suitable for use over a wide range of engine working conditions. However, some organic sunscreen compounds used in the present invention may provide optimal effects under a particular narrow range of engine working conditions, such as under mild conditions and more suitably under harsh conditions.

The liquid fuel composition of comprises a diesel base fuel suitable for use in an internal combustion engine and one or more organic sunscreen compounds. Therefore the liquid fuel composition of the present invention is a diesel composition.

There is no particular limitation on the type of organic sunscreen compound which can be used in the present invention as long as it is suitable for use in a diesel composition.

A wide variety of conventional organic sunscreen actives are suitable for use herein. Sagarin, et al., at Chapter VIII, pages 189 et seq., of Cosmetics Science and Technology (1972), and pages 9 to 26 and 67 to 177 of 'The Encyclopedia of Ultraviolet Filters' by Nadim A. Shaath, 1st edition, published 2007, disclose numerous suitable actives.

Particularly preferred hydrophobic organic sunscreen actives useful in the composition of the present invention include: (i) alkyl β,β-diphenylacrylate and/or alpha-cyano-beta,beta-diphenylacrylate derivatives; (ii) salicylic derivatives; (iii) cinnamic derivatives; (iv) dibenzoylmethane derivatives; (v) camphor derivatives; (vi) benzophenone derivatives; (vii) p-aminobenzoic acid derivatives; and (viii) phenalkyl benzoate derivatives; and mixtures thereof.

Preferred alpha-cyano-beta, beta-diphenylacrylate derivatives include ethyl 2-cyano-3,3-diphenylacrylate, 2-ethylhexyl 2-cyano-3,3-diphenylacrylate, and mixtures thereof. More preferably the alpha-cyano-beta, beta-diphenylacrylate derivative is 2-ethylhexyl 2-cyano-3,3-diphenylacrylate, of which the International Non Proprietary Name is Octocrylene. 2-ethylhexyl 2-cyano-3,3-diphenylacrylate is commercially available under the tradename Parsol 340® from DSM Nutritional Products, Inc.

Preferred salicylate derivatives include ethylhexyl salicylate (octyl salicylate), triethanolamine salicylate, 3,3,5-trimethylcyclohexylsalicylate, homomenthyl salicylate, and mixtures thereof. More preferably, the salicylate derivative is ethylhexyl salicylate. Ethylhexyl salicylate is commercially available under the tradename Parsol EHS® from DSM Nutritional Products, Inc.

Preferred cinnamic derivatives are selected from octylmethoxy cinnamate, diethanolamine methoxycinnamate, and mixtures thereof. A particularly preferred cinnamic derivative for use herein is octylmethoxy cinnamate. Octylmethoxy cinnamate is commercially available under the tradename Parsol MCX® from DSM Nutritional Products, Inc.

Preferred dibenzoylmethane derivatives for use herein are selected from butyl methoxy dibenzoylmethane, ethylhexyl methoxy dibenzoylmethane, isopropyl dibenzoylmethane, and mixtures thereof. A particularly preferred dibenzoylmethane derivative for use herein is butyl methoxy dibenzoylmethane. Butyl methoxy dibenzoylmethane is commercially available under the tradename Parsol 1789® from DSM Nutritional Products, Inc.

A preferred camphor derivative for use herein is 4-methylbenzylidene camphor. 4-methylbenzylidene camphor is commercially available under the tradename Parsol 5000® from DSM Nutritional Products, Inc.

Preferred benzophenone derivatives for use herein are selected from benzophenone-1, benzophenone-2, benzophenone-3, benzophenone-4, benzophenone-5, benzophenone-6, benzophenone-7, benzophenone-8, benzophenone-9, benzophenone-10, benzophenone-11, benzophenone-12, and mixtures thereof. A particularly preferred benzophenone derivative for use herein is benzophenone-3. Benzophenone-3 is commercially available under the tradename Escalol 567® from Ashland Specialty Ingredients.

A preferred phenalkyl benzoate derivatives for use herein is phenethyl benzoate. Phenethyl benzoate is commercially available under the tradename X-tend 229® from Ashland Specialty Ingredients.

The amount of the one or more organic sunscreen compounds in the liquid fuel composition is preferably at most 2 wt %, by weight of the liquid fuel composition. The amount of the one or more organic sunscreen compounds is preferably at least 10 ppmw, by weight of the liquid fuel composition. The amount of the one or more organic sunscreen compounds is more preferably in the range of from 1 wt % to 0.005 wt %, more preferably in the range of from 0.5 wt % to 0.01 wt %, even more preferably in the range of from 0.05 wt % to 0.01 wt %, by weight of the liquid fuel composition.

Where a combination of two or more organic sunscreen compounds is used in the fuel composition, the same concentration ranges may apply to the total combination of organic sunscreen compounds. It will be appreciated that amounts/concentrations may also be expressed as ppm, in which case 1% w/w corresponds to 10,000 ppm w/w.

The organic sunscreen compound may be blended together with any other additives e.g. additive performance package(s) to produce an additive blend. The additive blend is then added to a base fuel to produce a liquid fuel composition. The amount of organic sunscreen in the additive blend is preferably in the range of from 0.1 to 99.8 wt %, more preferably in the range of from 5 to 70 wt %, by weight of the additive blend.

The amount of performance package(s) in the additive blend is preferably in the range of from 0.1 to 99.8 wt %, more preferably in the range of from 5 to 50 wt %, by weight of the additive blend.

Preferably, the amount of the performance package present in the liquid fuel composition of the present invention is in the range of 15 ppmw (parts per million by weight) to 10% wt, based on the overall weight of the liquid fuel composition. More preferably, the amount of the performance package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt
(xv) at most 5% wt.

Typically, the additive blend containing the organic sunscreen compound and the additive (performance) package may additionally contain other additive components such as detergents, anti-foaming agents, corrosion inhibitors, dehazers etc. Alternatively, the organic sunscreen compound may be blended directly with the base fuel.

The remainder of the composition will typically consist of one or more automotive base fuels optionally together with one or more fuel additives, for instance as described in more detail below.

The relative proportions of the one or more organic sunscreen compounds, fuel components and any other components or additives present in a diesel fuel composition prepared according to the invention may also depend on other desired properties such as density, emissions performance and viscosity.

The diesel fuel used as the base fuel in the present invention includes diesel fuels for use in automotive compression ignition engines, as well as in other types of engine such as for example off road, marine, railroad and stationary engines. The diesel fuel used as the base fuel in the liquid fuel composition of the present invention may conveniently also be referred to as 'diesel base fuel'.

The diesel base fuel may itself comprise a mixture of two or more different diesel fuel components, and/or be additivated as described below.

Such diesel fuels will contain one or more base fuels which may typically comprise liquid hydrocarbon middle distillate gas oil(s), for instance petroleum derived gas oils. Such fuels will typically have boiling points within the usual diesel range of 150 to 400° C., depending on grade and use. They will typically have a density from 750 to 1000 kg/m$^3$, preferably from 780 to 860 kg/m$^3$, at 15° C. (e.g. ASTM D4502 or IP 365) and a cetane number (ASTM D613) of from 35 to 120, more preferably from 40 to 85. They will typically have an initial boiling point in the range 150 to 230° C. and a final boiling point in the range 290 to 400° C. Their kinematic viscosity at 40° C. (ASTM D445) might suitably be from 1.2 to 4.5 mm$^2$/s.

An example of a petroleum derived gas oil is a Swedish Class 1 base fuel, which will have a density from 800 to 820 kg/m$^3$ at 15° C. (SS-EN ISO 3675, SS-EN ISO 12185), a T95 of 320° C. or less (SS-EN ISO 3405) and a kinematic viscosity at 40° C. (SS-EN ISO 3104) from 1.4 to 4.0 mm$^2$/s, as defined by the Swedish national specification EC1.

Optionally, non-mineral oil based fuels, such as biofuels or Fischer-Tropsch derived fuels, may also form or be present in the diesel fuel. Such Fischer-Tropsch fuels may for example be derived from natural gas, natural gas liquids, petroleum or shale oil, petroleum or shale oil processing residues, coal or biomass.

The amount of Fischer-Tropsch derived fuel used in the diesel fuel may be from 0% to 100% v of the overall diesel fuel, preferably from 5% to 100% v, more preferably from 5% to 75% v. It may be desirable for such a diesel fuel to contain 10% v or greater, more preferably 20% v or greater, still more preferably 30% v or greater, of the Fischer-Tropsch derived fuel. It is particularly preferred for such diesel fuels to contain 30 to 75% v, and particularly 30 to 70% v, of the Fischer-Tropsch derived fuel. The balance of the diesel fuel is made up of one or more other diesel fuel components.

Such a Fischer-Tropsch derived fuel component is any fraction of the middle distillate fuel range, which can be isolated from the (optionally hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. No. 5,766,274, U.S. Pat. No. 5,378,348, U.S. Pat. No. 5,888,376 and U.S. Pat. No. 6,204,426.

The Fischer-Tropsch product will suitably contain more than 80 wt % and more suitably more than 95 wt % iso and normal paraffins and less than 1 wt % aromatics, the balance being naphthenics compounds. The content of sulphur and nitrogen will be very low and normally below the detection limits for such compounds. For this reason the sulphur content of a diesel fuel composition containing a Fischer-Tropsch product may be very low.

The diesel fuel composition preferably contains no more than 5000 ppmw sulphur, more preferably no more than 500 ppmw, or no more than 350 ppmw, or no more than 150 ppmw, or no more than 100 ppmw, or no more than 70 ppmw, or no more than 50 ppmw, or no more than 30 ppmw, or no more than 20 ppmw, or most preferably no more than 10 ppmw sulphur.

Other diesel fuel components for use herein include the so-called "biofuels" which derive from biological materials. Examples include fatty acid alkyl esters (FAAE). Examples of such components can be found in WO2008/135602.

The diesel base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Detergent-containing diesel fuel additives are known and commercially available. Such additives may be added to diesel fuels at levels intended to reduce, remove, or slow the build-up of engine deposits.

Examples of detergents suitable for use in diesel fuel additives for the present purpose include polyolefin substituted succinimides or succinamides of polyamines, for instance polyisobutylene succinimides or polyisobutylene amine succinamides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

Other examples of detergents suitable for use in diesel fuel additives for the present purpose include compounds having at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties; and/or (A9) moieties obtained by Mannich reaction of substituted phenols with aldehydes and mono- or polyamines.

Other detergents suitable for use in diesel fuel additives for the present purpose include quaternary ammonium salts such as those disclosed in US2012/0102826, US2012/0010112, WO2011/149799, WO2011/110860, WO2011/095819 and WO2006/135881.

The diesel fuel additive mixture may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide, those peroxide compounds disclosed in WO96/03397 and WO99/32584 and those ignition improvers disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; and wax anti-settling agents.

The diesel fuel additive mixture may contain a lubricity enhancer, especially when the diesel fuel composition has a low (e.g. 500 ppmw or less) sulphur content. In the additivated diesel fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, III (1986) 217-235;
- WO-A-95/33805—cold flow improvers to enhance lubricity of low sulphur fuels;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the diesel fuel composition to contain an anti-foaming agent, more preferably in combination with an anti-rust agent and/or a corrosion inhibitor and/or a lubricity enhancing additive.

Unless otherwise stated, the (active matter) concentration of each such optional additive component in the additivated diesel fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the diesel fuel composition will preferably be in the range from 0.1 to 20 ppmw, more preferably from 1 to 15 ppmw, still more preferably from 1 to 10 ppmw, and especially from 1 to 5 ppmw. The (active matter) concentration of any ignition improver (e.g. 2-EHN) present will preferably be 2600 ppmw or less, more preferably 2000 ppmw or less, even more preferably 300 to 1500 ppmw. The (active matter) concentration of any detergent in the diesel fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the diesel fuel composition may be suitably between 0 and 10000 ppmw and preferably below 5000 ppmw.

In the above, amounts (concentrations, % vol, ppmw, % wt) of components are of active matter, i.e. exclusive of volatile solvents/diluent materials.

The liquid fuel composition of the present invention is produced by admixing the essential one or more organic sunscreen compounds with a diesel base fuel suitable for use in an internal combustion engine. Since the base fuel to which the essential fuel additive is admixed is a diesel, then the liquid fuel composition produced is a diesel composition.

It has been found that the use of one or more organic sunscreen compounds in liquid fuel compositions provides benefits in terms of increased cetane number, modified ignition delay and/or modified burn period.

The present invention will be further understood from the following examples. Unless otherwise stated, all amounts and concentrations disclosed in the examples are based on weight of the fully formulated fuel composition. Some results are given in bar; 1 bar is 100 kPa.

EXAMPLES

Example 1

Combustion Properties of Fuels Containing Organic Sunscreens/UV Absorbers

Certain organic sunscreens were blended at various levels into a standard low sulphur diesel fuel compliant with EN590. The specification of the base fuel is shown in Table 2 below. The sunscreen/UV absorber additives used in this example are detailed in Table 1 below.

TABLE 1

| Chemical Name | Tradename |
|---|---|
| Octocrylene | Escalol 597; Parsol 340 |
| Ethylhecyl Salicylate | Escalol 587; Parsol EHS |
| Ethylhexyl Methoxycinnamate | Escalol 557; Parsol MCX |
| Butyl Methoxydibenzoylmethane | Escalol 517; Parsol 1789 |
| 4-methylbenzylidene camphor | Parsol 5000 |
| Oxybenzone | Escalol 567 |
| Ethylhexyl Dimethyl PABA | Escalol 507 |
| Phenethyl Benzoate | X-tend 226 |

All compounds with Parsol tradenames are supplied by DSM International. All compounds with Escalol and X-tend tradenames are supplied by Ashland.

TABLE 2

| Parameter | Method | Units | |
|---|---|---|---|
| Cetane Number | ASTM D613 | — | 53.8 |
| Derived Cetane Number - 2006 | IP498/06 | — | 54.1 |
| Density @ 15° C. | IP 365 | g cm$^{-3}$ | 0.8250 |
| Distillation | IP 123 | | |
| IBP | | ° C. | 172.0 |
| 10% rec | | ° C. | 195.6 |
| 20% rec | | ° C. | 205.3 |
| 30% rec | | ° C. | 215.0 |
| 40% rec | | ° C. | 226.7 |
| 50% rec | | ° C. | 239.9 |
| 60% rec | | ° C. | 254.4 |
| 70% rec | | ° C. | 269.6 |
| 80% rec | | ° C. | 288.2 |
| 90% rec | | ° C. | 311.2 |
| 95% rec | | ° C. | 328.6 |
| FBP | | ° C. | 342.0 |
| Residue | | % vol | 1.1 |
| Recovery | | % vol | 98.3 |

TABLE 2-continued

| Parameter | Method | Units | |
|---|---|---|---|
| Loss | | % vol | 0.6 |
| Rec @ 240 C. | | % vol | 50.8 |
| Rec @ 250 C. | | % vol | 57.5 |
| Rec @ 340 C. | | % vol | 97.7 |
| Lubricity | ISO 12156 | μm | 277, 266 |
| Viscosity @ 40° C. | IP 71 | $mm^2 s^{-1}$ | 2.078 |
| Sulphur - WD XRF | ISO 20884 | mg/kg | 9.0 |
| CFPP | IP 309 | ° C. | −34 |
| Cloud point | IP 219 | ° C. | −13 |
| Mono | IP 391/06 | % m/m | 24.5 |
| Di | IP 391/06 | % m/m | 2.9 |
| Tri | IP 391/06 | % m/m | 0.5 |
| Total | IP 391/06 | % m/m | 27.9 |
| Polycyclic aromatic hydrocarbons | IP 391/06 | % m/m | |
| Fatty acid methyl ester content by FTIR | EN 14078 | % vol | zero |

The fuel blends to be tested were subjected to ignition testing in a Combustion Research Unit (CRU) obtained from Fueltech Solutions AS/Norway. Fuels were injected into a constant volume combustion chamber preconditioned as set out in Table 3 below.

TABLE 3

| Conditions | Label | Pif (bar) | Pi (bar) | Ti (° C.) |
|---|---|---|---|---|
| a-01 | low p/high T | 900 | 30 | 590 |
| a-02 | mid p/high T | 900 | 50 | 590 |
| a-03 | high p/high T | 900 | 75 | 590 |
| a-04 | low p/mid T | 900 | 30 | 560 |
| a-05 | mid p/mid T | 900 | 50 | 560 |

TABLE 3-continued

| Conditions | Label | Pif (bar) | Pi (bar) | Ti (° C.) |
|---|---|---|---|---|
| a-06 | high p/mid T | 900 | 75 | 560 |
| a-07 | low p/low T | 900 | 30 | 530 |
| a-10 | mid p/low T | 900 | 50 | 530 |
| a-09 | high p/low T | 900 | 75 | 530 |
| a-11 | Max Power | 1400 | 65 | 590 |
| a-08 | IQT | 200 | 21.4 | 570 |

The Derived Ignition Quality (DIQ) was determined as a function of Ignition Delay (ID) recorded as the time from start of injection (SOI) to the point where the chamber pressure has risen to 0.2 bar above the pressure before SOI, denoted as $DIQ^{0.2}$ ($ID^{0.2}$). The results of these experiments are shown in Tables 4-8.

The Derived Ignition Quality (DIQ) can also be determined as a function of Ignition Delay (ID) recorded as the time from start of injection (SOI) to the point where the chamber pressure equals its initial value plus 5% of maximum pressure increase (MPI), denoted as $DIQ^{5\%}$ ($ID^{5\%}$).

The burn period in this example is given as the time from the moment where the chamber pressure equals its initial value plus 10% of MPI to the moment when the chamber pressure equals its initial value plus 90% of MPI.

In Tables 4-8, the following abbreviations are used:

EHDPABA=Ethylhexyl Dimethyl PABA
OB=Oxybenzone
BMDBM=Butyl Methoxydibenzoylmethane
OC=Octocrylene
MBC=4-methylbenzylidene camphor
EHS=ethylhexyl salicylate
EHMOC=Ethylhexyl Methoxycinnamate
PEB=Phenethyl Benzoate

TABLE 4

(DIQ 5%)

| | Treat rate | % difference from base fuel | | | | | | | | | | |
|---|---|---|---|---|---|---|---|---|---|---|---|---|
| | (ppm) | a-01 | a-02 | a-03 | a-04 | a-05 | a-06 | a-07 | a-08 | a-09 | a-10 | a-11 |
| EHDPABA | 5000 | 1.14 | 15.63 | 6.06 | 0.79 | 1.48 | 0.17 | 1.57 | −0.87 | −0.68 | 4.70 | 36.83 |
| EHDPABA | 500 | −2.78 | −7.72 | 4.45 | 0.60 | −0.41 | 3.07 | 0.31 | −1.13 | −1.01 | 2.41 | 14.11 |
| OB | 5000 | 0.31 | 5.93 | 4.08 | −0.09 | 0.26 | 2.98 | 0.53 | 0 | −1.52 | 2.46 | 15.59 |
| OB | 500 | −0.63 | 16.06 | 5.12 | −0.63 | −1.18 | 0.67 | −2.58 | 0.07 | 3.48 | −1.06 | −6.84 |
| BMDBM | 5000 | −4.23 | 13.91 | 2.64 | −1.21 | −1.43 | 1.50 | −1.71 | −0.25 | 1.94 | −0.57 | 0.89 |
| BMDBM | 500 | −3.37 | 15.04 | 4.47 | −2.39 | −0.60 | −0.85 | −1.76 | −1.63 | −0.71 | −1.05 | −25.94 |
| OC | 5000 | −1.94 | 7.48 | 4.89 | 1.60 | 1.29 | 5.10 | −0.34 | 1.40 | 5.19 | 3.29 | 4.36 |
| OC | 500 | −1.41 | 14.82 | 4.51 | 0.92 | −0.46 | 4.37 | −0.59 | −0.77 | 1.49 | 1.53 | 3.13 |
| MBC | 5000 | −2.87 | 4.27 | 5.12 | 1.54 | 0.81 | −0.36 | 0.03 | 1.40 | 2.46 | 1.40 | −6.51 |
| MBC | 500 | −2.94 | 14.76 | 2.53 | −0.44 | −2.51 | −0.79 | −0.49 | −2.44 | 3.46 | 0.86 | −7.34 |
| EHS | 5000 | −2.66 | 1.77 | 5.23 | 1.22 | 3.59 | 1.80 | 0.06 | −0.41 | 3.02 | 3.00 | 12.80 |
| EHS | 500 | −2.71 | 15.99 | 3.03 | 0.32 | −1.83 | −0.34 | −1.14 | −0.17 | 0.25 | −2.15 | −7.79 |
| EHMOC | 5000 | −0.59 | 16.60 | 3.68 | 1.71 | 0.65 | 3.61 | 0.23 | 1.26 | 2.49 | 0.32 | 3.17 |
| EHMOC | 500 | −2.58 | 13.97 | 1.84 | −0.67 | −1.67 | 1.02 | −1.61 | −0.20 | 7.72 | 0.28 | 2.76 |
| PEB | 5000 | −3.29 | 16.39 | 2.02 | 1.34 | −3.37 | 1.95 | −0.28 | 0.45 | 2.05 | 0.13 | −16.68 |
| PEB | 500 | −0.58 | 15.66 | 0.96 | −0.78 | −1.51 | −2.76 | −2.75 | −1.94 | 1.99 | 0.02 | 1.52 |

TABLE 5

(DIQ 0.2 ft)

| | Treat rate | % difference from base fuel | | | | | | | | | | |
|---|---|---|---|---|---|---|---|---|---|---|---|---|
| | (ppm) | a-01 | a-02 | a-03 | a-04 | a-05 | a-06 | a-07 | a-08 | a-09 | a-10 | a-11 |
| EHDPABA | 5000 | 1.08 | 1.47 | 0.81 | 0.31 | 0.69 | −0.10 | 0.48 | −0.29 | 0.87 | 3.88 | −0.37 |
| EHDPABA | 500 | 0.68 | 0.90 | 0.20 | −0.16 | 0.42 | 2.08 | 0.20 | −0.89 | −0.26 | 0.96 | −2.72 |

TABLE 5-continued (DIQ 0.2 ft)

| | Treat rate | % difference from base fuel | | | | | | | | | | |
|---|---|---|---|---|---|---|---|---|---|---|---|---|
| | (ppm) | a-01 | a-02 | a-03 | a-04 | a-05 | a-06 | a-07 | a-08 | a-09 | a-10 | a-11 |
| OB | 5000 | −0.16 | 3.04 | 0.59 | 0.69 | −0.22 | 1.31 | 0.60 | −0.12 | −1.46 | 2.19 | −0.96 |
| OB | 500 | −2.01 | 0.29 | 0.14 | −0.20 | −0.51 | −0.65 | −3.19 | −0.45 | 0.70 | 0.16 | −1.06 |
| BMDBM | 5000 | −3.77 | −1.48 | −1.47 | −1.57 | −1.21 | −0.27 | −1.42 | −0.69 | −0.09 | −0.47 | −2.31 |
| BMDBM | 500 | −1.03 | 0.43 | 1.40 | −1.54 | −0.71 | −1.55 | −2.00 | −1.61 | −0.01 | −0.40 | −2.67 |
| OC | 5000 | 1.97 | 4.03 | 0.93 | 1.86 | 1.27 | 3.15 | 0.61 | 1.40 | 3.27 | 3.99 | 1.25 |
| OC | 500 | −0.65 | 0.36 | 1.26 | 0.54 | −0.43 | 1.56 | −1.24 | −0.62 | 1.79 | 0.29 | −0.99 |
| MBC | 5000 | −2.29 | 0.88 | 0.92 | 1.05 | 1.47 | 0.16 | 0.38 | 0.97 | 1.87 | −0.35 | 0.81 |
| MBC | 500 | −0.72 | −1.00 | −1.09 | −1.59 | −0.93 | −0.19 | −1.28 | −1.76 | 2.41 | 1.21 | −2.64 |
| EHS | 5000 | 0.57 | −0.56 | 0.67 | −0.05 | 1.44 | 2.03 | 0.19 | 0.15 | 2.17 | 4.11 | −1.62 |
| EHS | 500 | −1.61 | 0.89 | −1.09 | −0.33 | −1.38 | 0.17 | −1.37 | −0.48 | −0.50 | −2.71 | −0.17 |
| EHMOC | 5000 | −0.25 | 2.25 | −0.19 | 0.65 | −0.19 | 2.56 | 0.12 | 1.18 | 0.72 | −0.22 | −0.13 |
| EHMOC | 500 | −0.37 | −0.92 | −2.44 | −1.34 | −0.34 | 0.93 | −1.78 | −0.62 | 3.98 | −0.20 | −0.87 |
| PEB | 5000 | 1.01 | 1.07 | −1.64 | 0.89 | −2.12 | 0.59 | −0.45 | 0.45 | 1.92 | 1.06 | −1.57 |
| PEB | 500 | −1.96 | −0.05 | −2.97 | −0.80 | −0.68 | −2.20 | −2.72 | −1.03 | 0.91 | 0.71 | −1.72 |

TABLE 6

(ID 5%)

| | Treat rate | % difference from base fuel | | | | | | | | | | |
|---|---|---|---|---|---|---|---|---|---|---|---|---|
| | (ppm) | a-01 | a-02 | a-03 | a-04 | a-05 | a-06 | a-07 | a-08 | a-09 | a-10 | a-11 |
| EHDPABA | 5000 | −0.40 | −6.09 | −2.44 | −0.27 | −0.44 | −0.06 | −0.55 | 0.42 | 0.13 | −1.15 | −10.03 |
| EHDPABA | 500 | 1.01 | 3.03 | −1.83 | −0.21 | 0.12 | −0.99 | −0.11 | 0.54 | 0.20 | −0.60 | −5.26 |
| OB | 5000 | −0.11 | −2.32 | −1.68 | 0.03 | −0.08 | −0.96 | −0.19 | −0.01 | 0.30 | −0.61 | −5.70 |
| OB | 500 | 0.23 | −6.25 | −2.08 | 0.22 | 0.35 | −0.22 | 0.92 | −0.04 | −0.68 | 0.27 | 2.88 |
| BMDBM | 5000 | 1.54 | −5.42 | −1.12 | 0.42 | 0.43 | −0.49 | 0.60 | 0.12 | −0.38 | 0.14 | −0.48 |
| BMDBM | 500 | 1.22 | −5.86 | −1.83 | 0.83 | 0.18 | 0.28 | 0.62 | 0.79 | 0.14 | 0.27 | 12.72 |
| OC | 5000 | 0.70 | −2.93 | −2.00 | −0.55 | −0.38 | −1.62 | 0.11 | −0.66 | −1.01 | −0.81 | −1.86 |
| OC | 500 | 0.51 | −5.77 | −1.85 | −0.32 | 0.14 | −1.40 | 0.20 | 0.37 | −0.29 | −0.38 | −1.38 |
| MBC | 5000 | 1.04 | −1.68 | −2.09 | −0.53 | −0.24 | 0.11 | −0.02 | −0.66 | −0.48 | −0.35 | 2.73 |
| MBC | 500 | 1.07 | −5.75 | −1.07 | 0.15 | 0.65 | 0.26 | 0.17 | 1.20 | −0.68 | −0.22 | 3.11 |
| EHS | 5000 | 0.96 | −0.70 | −2.13 | −0.42 | −1.06 | −0.59 | −0.03 | 0.19 | −0.59 | −0.75 | −4.85 |
| EHS | 500 | 0.98 | −6.23 | −1.27 | −0.11 | −0.55 | 0.11 | 0.4 | 0.08 | −0.05 | 0.55 | 3.31 |
| EHMOC | 5000 | 0.21 | −6.46 | −1.53 | −0.59 | −0.20 | −1.16 | 0.07 | −0.60 | −0.49 | −0.08 | −1.40 |
| EHMOC | 500 | 0.93 | −5.45 | −0.80 | 0.23 | 0.50 | −0.34 | 0.57 | 0.09 | −1.49 | −0.07 | −1.23 |
| PEB | 5000 | 1.20 | −6.38 | −0.87 | −0.46 | 1.02 | −0.64 | 0.09 | −0.22 | −0.40 | −0.03 | 7.66 |
| PEB | 500 | 0.21 | −6.10 | −0.45 | 0.27 | 0.45 | 0.92 | 0.98 | 0.95 | −0.39 | −0.01 | −0.74 |

TABLE 7

(ID 0.2 ft)

| | Treat rate | % difference from base fuel | | | | | | | | | | |
|---|---|---|---|---|---|---|---|---|---|---|---|---|
| | (ppm) | a-01 | a-02 | a-03 | a-04 | a-05 | a-06 | a-07 | a-08 | a-09 | a-10 | a-11 |
| EHDPABA | 5000 | −0.38 | −0.66 | −0.34 | −0.11 | −0.30 | 0.04 | −0.16 | 0.13 | −0.28 | −1.04 | 0.19 |
| EHDPABA | 500 | −0.24 | −0.41 | −0.09 | 0.06 | −0.18 | −0.95 | −0.7 | 0.39 | 0.08 | −0.26 | 1.53 |
| OB | 5000 | 0.06 | −1.37 | −0.25 | −0.25 | 0.09 | −0.60 | −0.20 | 0.05 | 0.47 | −0.59 | 0.52 |
| OB | 500 | 0.72 | −0.13 | −0.06 | 0.07 | 0.22 | 0.30 | 1.05 | 0.19 | −0.22 | −0.04 | 0.57 |
| BMDBM | 5000 | 1.36 | 0.68 | 0.64 | 0.57 | 0.53 | 0.12 | 0.46 | 0.30 | 0.03 | 0.13 | 1.29 |
| BMDBM | 500 | 0.36 | −0.19 | −0.59 | 0.56 | 0.30 | 0.73 | 0.65 | 0.70 | 0.00 | 0.11 | 1.50 |
| OC | 5000 | −0.69 | −1.80 | −0.39 | −0.67 | −0.55 | −1.42 | −0.20 | −0.61 | −1.02 | −1.06 | −0.69 |
| OC | 500 | 0.23 | −0.17 | −0.53 | −0.20 | 0.18 | −0.72 | 0.40 | 0.27 | −0.57 | −0.08 | 0.54 |
| MBC | 5000 | 0.82 | −0.40 | −0.39 | −0.38 | −0.63 | −0.08 | −0.13 | −0.42 | −0.59 | 0.10 | −0.45 |
| MBC | 500 | 0.26 | 0.46 | 0.47 | 0.58 | 0.40 | 0.08 | 0.41 | 0.77 | −0.76 | −0.33 | 1.48 |
| EHS | 5000 | −0.20 | 0.25 | −0.28 | 0.02 | −0.62 | −0.93 | −0.07 | −0.07 | −0.68 | −1.09 | 0.89 |
| EHS | 500 | 0.57 | −0.41 | 0.47 | 0.12 | 0.60 | −0.08 | 0.44 | 0.21 | 0.16 | 0.75 | 0.08 |
| EHMOC | 5000 | 0.09 | −1.01 | 0.08 | −0.23 | 0.08 | −1.17 | −0.04 | −0.51 | −0.23 | 0.06 | 0.06 |
| EHMOC | 500 | 0.13 | 0.42 | 1.07 | 0.49 | 0.14 | −0.43 | 0.57 | 0.27 | −1.24 | 0.05 | 0.47 |
| PEB | 5000 | −0.36 | −0.48 | 0.71 | −0.32 | 0.93 | −0.28 | 0.14 | −0.20 | −0.61 | −0.29 | 0.86 |
| PEB | 500 | 0.70 | 0.02 | 1.31 | 0.29 | 0.29 | 1.05 | 0.89 | 0.45 | −0.29 | −0.19 | 0.95 |

TABLE 8

| | Treat rate | (Burn Period) % difference from base fuel | | | | | | | | | | |
|---|---|---|---|---|---|---|---|---|---|---|---|---|
| | (ppm) | a-01 | a-02 | a-03 | a-04 | a-05 | a-06 | a-07 | a-08 | a-09 | a-10 | a-11 |
| EHDPABA | 5000 | −1.10 | 9.32 | 2.05 | 2.22 | −2.87 | −6.56 | 1.03 | −0.38 | −0.66 | 3.20 | −2.62 |
| EHDPABA | 500 | 1.57 | −2.73 | 3.77 | 0.48 | −1.11 | −5.18 | 2.38 | 2.24 | 6.41 | 2.44 | −5.49 |
| OB | 5000 | −1.03 | 5.00 | −1.21 | 2.72 | −0.03 | −9.10 | 2.28 | −0.31 | 2.43 | 6.25 | 2.22 |
| OB | 500 | −0.53 | 8.22 | 0.05 | 2.03 | −2.03 | −8.94 | 1.41 | 1.24 | 2.25 | 6.26 | 3.26 |
| BMDBM | 5000 | 1.13 | 8.17 | 0.69 | 1.94 | 0.70 | −6.51 | 3.52 | 0.74 | 4.49 | 2.62 | 2.53 |
| BMDBM | 500 | 7.17 | 14.88 | 0.32 | 0.24 | −1.35 | −10.60 | 2.83 | 1.01 | 1.49 | 2.88 | −2.13 |
| OC | 5000 | 4.11 | 4.33 | 2.27 | −2.27 | −3.54 | 15.00 | 1.54 | 0.23 | 0.70 | 1.33 | 4.81 |
| OC | 500 | −1.29 | 8.01 | −1.04 | 0.30 | −1.25 | 0.56 | 3.76 | −0.25 | 4.06 | −0.22 | −3.07 |
| MBC | 5000 | 0.00 | −1.11 | 0.15 | 3.71 | 3.09 | −12.78 | 1.82 | 2.97 | 1.64 | 4.42 | 11.52 |
| MBC | 500 | 4.38 | 5.96 | 0.87 | 1.15 | 1.54 | −2.83 | 3.88 | 4.15 | 3.11 | −1.55 | −5.09 |
| EHS | 5000 | 1.64 | 1.54 | 3.08 | −0.02 | −1.27 | −4.92 | 1.22 | 2.81 | 1.06 | 0.86 | 0.41 |
| EHS | 500 | 0.46 | 12.12 | 1.10 | −2.84 | −1.68 | −5.20 | 2.92 | −3.49 | 1.02 | 0.67 | 9.97 |
| EHMOC | 5000 | 2.64 | 7.73 | 1.01 | −0.87 | −2.75 | −6.31 | 3.19 | 0.67 | 3.24 | 6.06 | 1.60 |
| EHMOC | 500 | 8.42 | 7.76 | 0.96 | 1.36 | 2.31 | −8.14 | 4.11 | −1.73 | 5.55 | 2.07 | −1.67 |
| PEB | 5000 | 2.14 | 7.51 | 0.32 | 1.26 | −4.93 | −6.15 | 6.10 | −2.30 | 6.74 | 0.03 | 3.50 |
| PEB | 500 | 2.91 | 7.19 | 3.14 | 2.95 | 3.33 | −0.79 | 4.96 | 0.75 | 4.56 | 2.68 | −1.17 |

Discussion

As can be seen from Tables 4-8, under some engine operating conditions, the organic sunscreen compounds tested in the Examples can provide an increase in cetane number and can modify the ignition delay and/or burn period of a diesel base fuel.

Example 2

In order to measure the effect of diesel fuel compositions of the invention, the following bench engine test was used. The engine used for this test was a Peugeot DW10 bench Engine. Table 9 below shows the details of the DW10 engine used in this test.

TABLE 9

| | |
|---|---|
| Vehicle Type | Peugeot |
| Engine Code | DW10 |
| Displacement (ltr)/Layout | 2.0/14 |
| Maximum Power (kW@rpm) | 100 kW @ 4000 r/min |
| Maximum Torque (Nm@rpm) | 320 Nm @ 2000 r/min |
| Manufacturer | Continental |
| Injection Type | Common Rail |
| EMS Manufacturer | Continental |
| Emmissions Class | Euro 4 |

The test procedure entailed running the candidate and the reference fuels through the engine, in each case alternating the candidate fuel and the reference fuel in succession. Each fuel set (candidate plus reference fuel) was tested under the steady state conditions of Table 10 below.

TABLE 10

| Engine Condition No. | Engine speed (rpm) | Torque (Nm) |
|---|---|---|
| 1 | 2000 | 330 |
| 2 | 4000 | 230 |

Under the above steady state conditions, each of PMAX (maximum pressure), APMAX (the timing at which PMAX is achieved as measured in crank angle degrees), and power output was recorded and the differences shown by the candidate fuel over the reference fuel was assessed.

The reference fuel was the same standard low sulphur EN590 compliant diesel fuel as used in Example 1 and which contained no FAME (fatty acid methyl ester) component. Organic sunscreen/UV absorber materials were added to the reference fuel to provide two test fuel blends A and B; details are given in Table 11 below (using the same abbreviations as given in Example 1):

TABLE 11

| Test Fuel | Organic sunscreen | Treat rate (ppm) |
|---|---|---|
| A | EHDPABA (Escalol 507) | 500 |
| B | OB (Escalol 567) | 500 |

The delta differences of results between each of the two test fuels and the reference fuel in the respective tests are shown in Table 12 below.

TABLE 12

| Test Fuel | Engine Condition | PMAX (bar) | APMAX (degrees) | Power Output(kW) |
|---|---|---|---|---|
| A | 1 | 0.11439 | −0.05064 | 0.0466 |
| A | 2 | 0.02878 | −0.03365 | 0.1243 |
| B | 1 | 0.09661 | −0.02160 | 0.0659 |
| B | 2 | 0.07926 | −0.07104 | 0.1363 |

Discussion

As would be appreciated by the skilled person in the art of engine testing, from these results the test fuels have enabled a higher maximum pressure (positive delta on PMAX) to be achieved in a shorter time (negative delta for crank angles degrees), all for an increased power output. It should be noted that at the order of magnitude of the engine test conditions (4000 rpm and 2000 rpm), the deltas achieved in these tests are extremely significant.

Example 3

Additional tests were run in order to measure the effect of diesel fuel compositions of the invention. In this Example, a single cylinder diesel research engine was used. The engine was manufactured by IAV, the cylinder is from a Mercedes OM646 Euro 5 emissions engine, and the combustion control was via a IAV F12RE control system.

The Table below shows the fuel compositions of the invention included in the test. The same Reference fuel as for Examples 1 and 2 was used and test fuels were prepared therefrom which each contained 500 ppm of the relevant chemical. Table 13 below indicates the sunscreen/UV absorber additives used in the tests of this Example.

TABLE 13

| Test Fuel | Chemical Name | Tradename |
|---|---|---|
| C | Ethylhecyl Salicylate | Parsol EHS |
| D | Butyl Methoxydibenzoylmethane | Parsol 1789 |
| E | Oxybenzone | Escalol 567 |
| F | Ethylhexyl Dimethyl PABA | Escalol 507 |

The test conditions are shown in Table 14 below.

TABLE 14

| Condition | Engine Speed (rpm) | IMEP (bar) | Injection Pressure (bar) | Control Method | Inlet Manifold Pressure (bar) | Exhaust Manifold Pressure (bar) | Boost | EGR*** (%) |
|---|---|---|---|---|---|---|---|---|
| 1 | 2000 | 6 | 650 | SOI* | 1.0 | 1.2 | YES | 0 |
| 2 | 2000 | 6 | 650 | AI50%** | 1.0 | 1.2 | YES | 0 & 20 |

*Calibrated to Start of Injection
**Calibrated to the mid-point of the heat release
***Exhaust Gas Recirculation The results are shown in the Tables below.

TABLE 15

Condition 1; SOI Sweep - SOI −10.5

| Test Fuel | 10% | 90% | Burn Period (deg) | Power Output (kW) |
|---|---|---|---|---|
| Reference | 2.485333 | 33.8895 | 31.40417 | 3.961917 |
| C | 2.418583 | 31.96933 | 29.55075 | 3.939083 |
| D | 2.238083 | 32.136 | 29.89792 | 4.0255 |
| E | 2.078917 | 31.87317 | 29.79425 | 4.029583 |
| F | 2.021 | 31.0095 | 28.9885 | 3.98575 |

TABLE 16

Condition 1; SOI Sweep - SOI −8.5

| Test Fuel | 10% | 90% | Burn Period (deg) | Power Output (kW) |
|---|---|---|---|---|
| Reference | 4.628667 | 36.5065 | 31.87783 | 3.980667 |
| C | 4.53 | 35.05583 | 30.52583 | 4.008833 |
| D | 4.368 | 34.86783 | 30.49983 | 4.02625 |
| E | 4.284333 | 33.733 | 29.44867 | 4.034917 |
| F | 4.35375 | 33.297 | 28.94325 | 4.02575 |

TABLE 17

Condition 2; EGR Sweep - EGR 0%

| Test Fuel | 10% | 90% | Burn Period (deg) |
|---|---|---|---|
| Reference | 6.895333 | 38.1955 | 31.30017 |
| C | 6.88675 | 36.462 | 29.57525 |
| D | 6.68075 | 36.9635 | 30.28275 |
| E | 6.837083 | 37.05967 | 30.22258 |
| F | 6.798333 | 35.7015 | 28.90317 |

TABLE 18

Condition 2; EGR Sweep - EGR 20%

| Test Fuel | 10% | 90% | Burn Period (deg) | Power Output (kW) |
|---|---|---|---|---|
| Reference | 7.397917 | 46.43883 | 39.04092 | 3.873083 |
| C | 7.51875 | 43.74783 | 36.22908 | 3.8915 |
| E | 7.458583 | 44.01733 | 36.55875 | 3.970583 |
| F | 7.452333 | 43.2225 | 35.77017 | 3.94 |

Discussion

In diesel engines, the lower the burn period the better. It can be seen across all of the test results above, and thus across a range of different test conditions, that the fuels compositions of the invention consistently provide a lower burn period than the Reference fuel (i.e. the fuel without the sunscreen/UV absorber added). Equally all compositions of the invention enable a higher power output at all conditions tested compared with the Reference or base fuel.

I claim:

1. A liquid fuel composition comprising:

(a) a diesel base fuel suitable for use in an internal combustion engine; and (b) one or more organic sunscreen compounds selected from the group consisting of octylmethoxy cinnamate, diethanolamine methoxycinnamate, 4-methylbenzylidene camphor, phenethyl benzoate, and mixtures thereof.

2. The liquid fuel composition of claim 1 wherein the total level of the one or more organic sunscreen compounds is in the range of from 10 ppmw to 2 wt %, by weight of the liquid fuel composition.

3. A method for modifying the ignition delay and/or increasing the cetane number and/or modifying the burn period of a diesel fuel composition, which method comprises adding to the composition an amount of at least one organic sunscreen compound selected from the group consisting of octylmethoxy cinnamate, diethanolamine methoxycinnamate, 4-methylbenzylidene camphor, phenethyl benzoate, and mixtures thereof.

4. A method of improving the power output of an internal combustion engine, said method comprising fueling the internal combustion engine with a liquid fuel composition of claim 1.

* * * * *